US008036575B2

(12) United States Patent
Tsuda

(10) Patent No.: US 8,036,575 B2
(45) Date of Patent: Oct. 11, 2011

(54) DEVELOPMENT DEVICE, IMAGE FORMING APPARATUS, AND PROCESS CARTRIDGE HAVING COMPACT STRUCTURE FOR DISCHARGING DEVELOPER

(75) Inventor: Kiyonori Tsuda, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 353 days.

(21) Appl. No.: 12/250,046

(22) Filed: Oct. 13, 2008

(65) Prior Publication Data

US 2009/0103951 A1 Apr. 23, 2009

(30) Foreign Application Priority Data

Oct. 19, 2007 (JP) ..... 2007-272111
May 12, 2008 (JP) ..... 2008-124980

(51) Int. Cl.
*G03G 15/08* (2006.01)

(52) U.S. Cl. ..... 399/254; 399/255; 399/256; 399/257; 399/258

(58) Field of Classification Search ..... 399/254–258
See application file for complete search history.

(56) References Cited

U.S. PATENT DOCUMENTS 5,436,703 A * 7/1995 DeYoung et al. ..... 399/256
6,198,895 B1 3/2001 Tsuda et al.
6,337,957 B1 1/2002 Tamaki et al.
6,522,855 B1 2/2003 Katoh et al.
7,024,133 B2 4/2006 Nagashima et al.
7,076,192 B2 7/2006 Tsuda et al.
7,136,610 B2 11/2006 Arai et al.
7,162,189 B2 1/2007 Tsuda et al.
7,184,691 B2 2/2007 Kita et al.
7,212,767 B2 5/2007 Hosokawa et al.
7,315,715 B2 1/2008 Tsuda et al.
7,321,744 B2 1/2008 Hosokawa et al.
7,398,038 B2 7/2008 Tsuda et al.
2006/0083555 A1 4/2006 Uchiyama et al.

(Continued)

FOREIGN PATENT DOCUMENTS

JP 2001-215797 8/2001

(Continued)

OTHER PUBLICATIONS

U.S. Appl. No. 12/166,951, filed Jul. 2, 2008, Satoru Miyamoto et al.

(Continued)

*Primary Examiner* — David Gray
*Assistant Examiner* — G. M. Hyder
(74) *Attorney, Agent, or Firm* — Oblon, Spivak, McClelland, Maier & Neustadt, L.L.P.

(57) ABSTRACT

In a development device for containing a developer and developing an electrostatic latent image formed on an image carrier, a supplier supplies fresh developer to the development device. A developer carrier carries the developer to be supplied to the electrostatic latent image formed on the image carrier. A plurality of conveyance members conveys the developer contained in the development device in an axial direction of the development device to form a circulation path. An outlet is provided in a wall of a conveyance path formed by one of the plurality of conveyance members and discharges the developer to an outside of the conveyance path. A discharge conveyance member forms a discharge conveyance path to convey the developer discharged from the outlet in the axial direction of the development device and to discharge the developer to an outside of the development device.

18 Claims, 9 Drawing Sheets

U.S. PATENT DOCUMENTS

| | | | |
|---|---|---|---|
| 2007/0081835 | A1 | 4/2007 | Tsuda et al. |
| 2007/0116494 | A1 | 5/2007 | Uno et al. |
| 2007/0140747 | A1 | 6/2007 | Kita et al. |
| 2007/0160392 | A1 | 7/2007 | Tsuda et al. |
| 2007/0166074 | A1 | 7/2007 | Hosokawa et al. |
| 2007/0177905 | A1 | 8/2007 | Hosokawa et al. |
| 2007/0212119 | A1 | 9/2007 | Kurenuma et al. |
| 2007/0264052 | A1 | 11/2007 | Yoshida et al. |
| 2007/0264054 | A1 | 11/2007 | Tsuda et al. |
| 2008/0003021 | A1 | 1/2008 | Hosokawa et al. |
| 2008/0038021 | A1 | 2/2008 | Tsuda et al. |
| 2008/0063433 | A1 | 3/2008 | Miyamoto et al. |
| 2008/0181670 | A1 | 7/2008 | Tsuda et al. |
| 2008/0187332 | A1 * | 8/2008 | Tsuda et al. ..... 399/27 |
| 2008/0240792 | A1 | 10/2008 | Kita et al. |

FOREIGN PATENT DOCUMENTS

| | | |
|---|---|---|
| JP | 2007-155852 | 6/2007 |
| JP | 2008-203814 | 9/2008 |

OTHER PUBLICATIONS

U.S. Appl. No. 12/059,392, filed Mar. 31, 2008, Susumu Tateyama et al.

U.S. Appl. No. 12/125,653, filed May 22, 2008, Tomofumi Inoue et al.

* cited by examiner

DEVELOPMENT DEVICE, IMAGE FORMING APPARATUS, AND PROCESS CARTRIDGE HAVING COMPACT STRUCTURE FOR DISCHARGING DEVELOPER

CROSS-REFERENCE TO RELATED APPLICATIONS

The present application is based on and claims priority to Japanese Patent Application Nos. 2007-272111, filed on Oct. 19, 2007, and 2008-124980, filed on May 12, 2008 in the Japan Patent Office, the entire contents of each of which are hereby incorporated herein by reference.

BACKGROUND OF THE INVENTION

1. Field of the Invention

Exemplary aspects of the present invention relate to a development device, an image forming apparatus, and a process cartridge, and more particularly, to a pre-mixed-type development device, and an image forming apparatus and a process cartridge incorporating the pre-mixed-type development device for supplying fresh carrier or developer to the development device.

2. Description of the Related Art

A related-art image forming apparatus, such as a copier, a facsimile machine, a printer, or a multifunction printer having at least one of copying, printing, scanning, and facsimile functions, includes a tandem-type image forming apparatus for forming a color toner image on a recording medium (e.g., a transfer sheet) based on image data scanned using electrophotography. Such image forming apparatus includes four image forming devices, in each of which a charger, a development device, and a cleaner surround an image carrier. Thus, for example, the chargers charge surfaces of the image carriers. An optical writer emits light beams onto the charged surfaces of the image carriers to form electrostatic latent images on the image carriers according to the image data. The development devices develop the electrostatic latent images with yellow, magenta, cyan, and black toners to form yellow, magenta, cyan, and black toner images on the image carriers, respectively. The toner images are transferred from the image carriers and superimposed onto an intermediate transfer belt. The superimposed toner images are then transferred onto a transfer sheet to form a color toner image on the transfer sheet. The cleaners clean the surfaces of the image carriers after the toner images are transferred from the image carriers onto the intermediate transfer belt. Finally, a fixing device applies heat and pressure to the transfer sheet bearing the color toner image to fix the color toner image on the transfer sheet, thus forming the final color toner image on the transfer sheet.

The development device may be a pre-mixed-type development device, in which fresh carrier particles (hereinafter "carrier") are added as needed to a developer containing toner and carrier, and which is itself contained in the development device. Accordingly, used carrier is discharged from the development device when the fresh carrier is added, preventing deterioration of toner image quality caused by carrier deterioration over time.

In one example of such a pre-mixed-type development device, when an amount of a developer conveyed to a developer outlet exceeds a predetermined level due to supply of fresh carrier, surplus developer overflows the developer outlet and is conveyed through a discharge conveyance path toward an opening provided in a bottom of the discharge conveyance path, so that the surplus developer falls from the opening into a waste developer container.

However, the discharge conveyance path protrudes from a side of the development device, increasing the size of the development device in a short direction of the development device. Consequently, in order to install such development device in the tandem-type image forming apparatus, more space is needed between the adjacent image forming devices, increasing the size of the image forming apparatus as a result.

Further, the discharge conveyance path is provided near a bottom of the development device. Accordingly, the waste developer container is provided at a position substantially below that of the development device. Consequently, when the development device is installed in the tandem-type image forming apparatus, the image forming apparatus has an increased height to prevent the waste developer container from interfering with the intermediate transfer belt provided below the development device.

Obviously, such increased size of the development device is undesirable, and accordingly, there is a need for a technology to decrease the size of the pre-mixed-type development device.

BRIEF SUMMARY OF THE INVENTION

This specification describes below a development device according to an exemplary embodiment of the present invention. In one exemplary embodiment of the present invention, the development device contains a developer containing toner and carrier and develops an electrostatic latent image formed on an image carrier. The development device includes a supplier, a developer carrier, a plurality of conveyance members, an outlet, and a discharge conveyance member. The supplier is configured to supply fresh carrier to the development device. The developer carrier is provided opposite the image carrier and is configured to carry the developer to be supplied to the electrostatic latent image formed on the image carrier. The plurality of conveyance members is configured to convey the developer contained in the development device in an axial direction of the development device to form a circulation path. The outlet is provided in a wall of a conveyance path formed by one of the plurality of conveyance members and is configured to discharge the developer to an outside of the conveyance path when an amount of the developer conveyed by the one of the plurality of conveyance members exceeds a predetermined height. The discharge conveyance member is configured to form a discharge conveyance path to convey the developer discharged from the outlet in the axial direction of the development device and to discharge the developer to an outside of the development device. The discharge conveyance path is disposed within a length in which the circulation path formed by the plurality of conveyance members is provided in a horizontal direction perpendicular to the axial direction of the development device.

This specification further describes below an image forming apparatus according to an exemplary embodiment of the present invention. In one exemplary embodiment of the present invention, the image forming apparatus includes an image carrier configured to carry an electrostatic latent image and a development device configured to contain a developer containing toner and carrier and to develop the electrostatic latent image formed on the image carrier. The development device includes a supplier, a developer carrier, a plurality of conveyance members, an outlet, and a discharge conveyance member. The supplier is configured to supply fresh carrier to the development device. The developer carrier is provided opposite the image carrier and is configured to carry the developer to be supplied to the electrostatic latent image formed on the image carrier. The plurality of conveyance members is configured to convey the developer contained in the development device in an axial direction of the development device to form a circulation path. The outlet is provided in a wall of a conveyance path formed by one of the plurality of conveyance members and is configured to discharge the developer to an outside of the conveyance path when an amount of the developer conveyed by the one of the plurality of conveyance members exceeds a predetermined height. The discharge conveyance member is configured to form a discharge conveyance path to convey the developer discharged from the outlet in the axial direction of the development device and to discharge the developer to an outside of the development device. The discharge conveyance path is disposed within a length in which the circulation path formed by the plurality of conveyance members is provided in a horizontal direction perpendicular to the axial direction of the development device.

This specification further describes below a process cartridge according to an exemplary embodiment of the present invention. In one exemplary embodiment of the present invention, the process cartridge is detachably attachable to an image forming apparatus, and includes an image carrier configured to carry an electrostatic latent image and a development device configured to contain a developer containing toner and carrier and to develop the electrostatic latent image formed on the image carrier. The development device and the image carrier are integrated into the process cartridge as a single unit. The development device includes a supplier, a developer carrier, a plurality of conveyance members, an outlet, and a discharge conveyance member. The supplier is configured to supply fresh carrier to the development device. The developer carrier is provided opposite the image carrier and is configured to carry the developer to be supplied to the electrostatic latent image formed on the image carrier. The plurality of conveyance members is configured to convey the developer contained in the development device in an axial direction of the development device to form a circulation path. The outlet is provided in a wall of a conveyance path formed by one of the plurality of conveyance members and is configured to discharge the developer to an outside of the conveyance path when an amount of the developer conveyed by the one of the plurality of conveyance members exceeds a predetermined height. The discharge conveyance member is configured to form a discharge conveyance path to convey the developer discharged from the outlet in the axial direction of the development device and to discharge the developer to an outside of the development device. The discharge conveyance path is disposed within a length in which the circulation path formed by the plurality of conveyance members is provided in a horizontal direction perpendicular to the axial direction of the development device.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
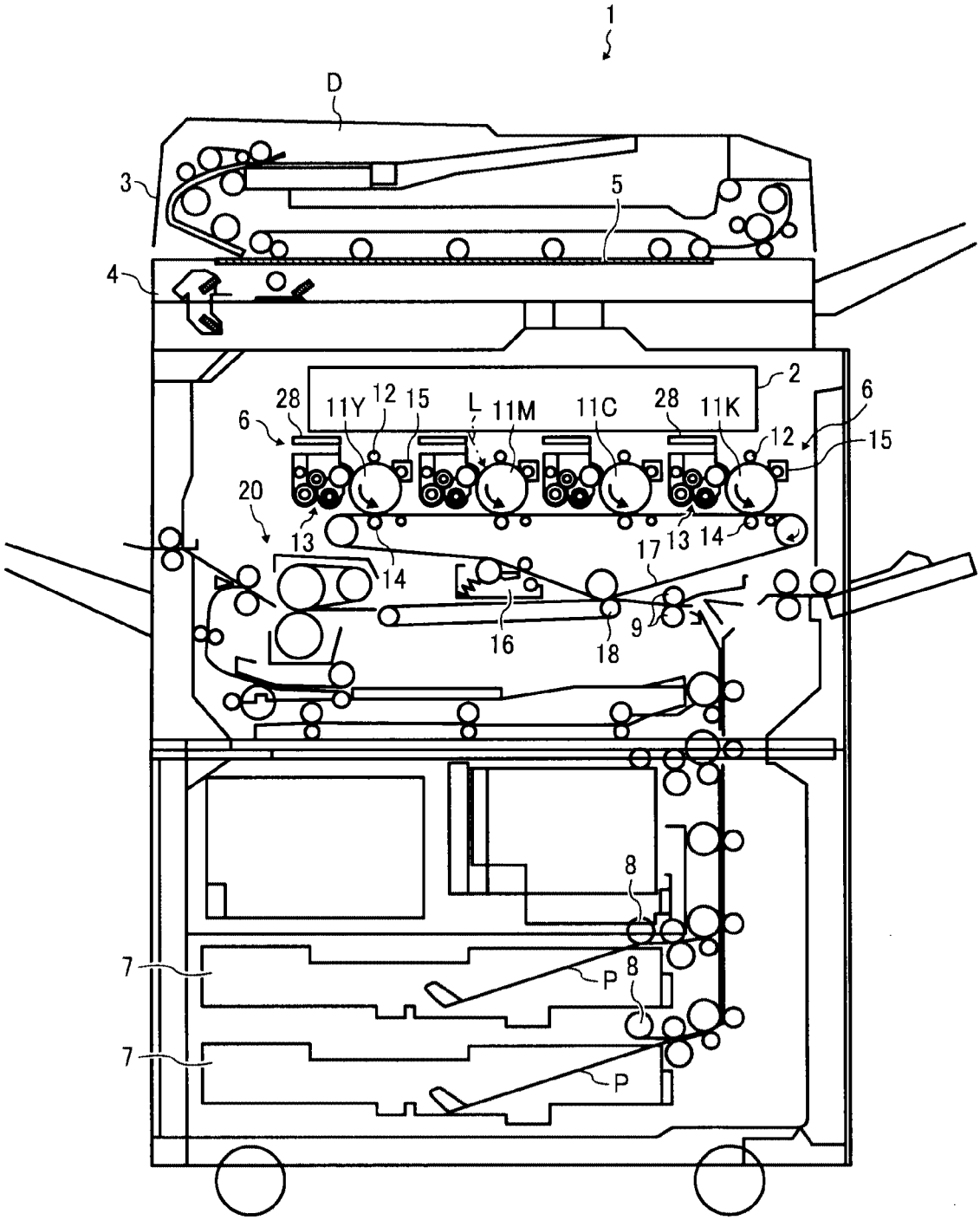
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 1 according to an exemplary embodiment of the present invention is explained.

As illustrated in FIG. 1, the image forming apparatus 1 includes an original document feeder 3, a reader 4, a writer 2, image forming devices 6, developer cartridges 28, first transfer bias rollers 14, an intermediate transfer belt 17, a belt cleaner 16, paper trays 7, feeding rollers 8, a registration roller pair 9, a second transfer bias roller 18, and a fixing device 20. The reader 4 includes an exposure glass 5. The image forming devices 6 include photoconductors 11Y, 11M, 11C, and 11K, chargers 12, development devices 13, and cleaners 15, respectively.

The image forming apparatus 1 can be a copier, a facsimile machine, a printer, a plotter, a multifunction printer having at least one of copying, printing, scanning, plotter, and facsimile functions, or the like. According to this non-limiting exemplary embodiment of the present invention, the image forming apparatus 1 functions as a tandem-type color copier for forming a color toner image on a recording medium by electrophotography.

The original document feeder 3 feeds an original document sheet D toward the reader 4. The reader 4 reads an image on the original document sheet D to generate image data. The writer 2 emits laser beams L to the image forming devices 6 according to the image data. Specifically, the chargers 12 charge surfaces of the photoconductors 11Y, 11M, 11C, and 11K (e.g., photoconductive drums), respectively. The writer 2 emits laser beams L onto the charged surfaces of the photoconductors 11Y, 11M, 11C, and 11K according to the image data generated by the reader 4 so as to form electrostatic latent images on the photoconductors 11Y, 11M, 11C, and 11K, respectively. The development devices 13 develop the electrostatic latent images formed on the photoconductors 11Y, 11M, 11C, and 11K, with yellow, magenta, cyan, and black toners to form yellow, magenta, cyan, and black toner images on the photoconductors 11Y, 11M, 11C, and 11K, respectively. The first transfer bias rollers 14 transfer and superimpose the yellow, magenta, cyan, and black toner images formed on the photoconductors 11Y, 11M, 11C, and 11K, respectively, onto the intermediate transfer belt 17 so as to form a color toner image on the intermediate transfer belt 17. The cleaners 15 remove residual toners not transferred and thereby remaining on the photoconductors 11Y, 11M, 11C, and 11K from the photoconductors 11Y, 11M, 11C, and 11K, respectively.

The paper trays 7 contain transfer sheets P serving as a recording medium. The feeding rollers 8 feed a transfer sheet P toward the registration roller pair 9. The registration roller pair 9 feeds the transfer sheet P toward the second transfer bias roller 18 at a proper time. The second transfer bias roller 18 transfers the color toner image formed on the intermediate transfer belt 17 onto the transfer sheet P fed by the registration roller pair 9. The belt cleaner 16 cleans the intermediate transfer belt 17. The fixing device 20 fixes the color toner image on the transfer sheet P.

The developer cartridges 28 are provided above the photoconductors 11Y, 11M, 11C, and 11K, respectively, and contain yellow, magenta, cyan, and black developers containing carrier (e.g., magnetic carrier) and yellow, magenta, cyan, and black toners (e.g., yellow, magenta, cyan, and black toner particles), respectively. The developer cartridges 28 serve as suppliers for supplying the yellow, magenta, cyan, and black developers to the development devices 13, respectively.

The following describes a series of image forming operations performed by the image forming apparatus 1 to form a color toner image on a transfer sheet P.

A feeding roller of the original document feeder 3 feeds an original document sheet D placed on an original document sheet tray of the original document feeder 3 toward the exposure glass 5 of the reader 4. The reader 4 optically reads an image on the original document sheet D placed on the exposure glass 5.

Specifically, in the reader 4, a lamp emits a light beam onto the original document sheet D placed on the exposure glass 5 in such a manner that the light beam scans the original document sheet D. The light beam reflected by the original document sheet D enters a color sensor via mirrors and a lens to form an image in the color sensor. The color sensor breaks down the light beam into RGB (red, green, blue) light beams, and converts the RGB light beams into RGB electric image signals. An image processor performs processing including color conversion processing, color correction processing, and space frequency correction processing based on the RGB electric image signals, so as to generate yellow, magenta, cyan, and black image data.

The writer 2 emits laser beams L onto the photoconductors 11Y, 11M, 11C, and 11K according to the yellow, magenta, cyan, and black image data sent from the reader 4.

The four photoconductors 11Y, 11M, 11C, and 11K rotate counterclockwise in FIG. 1. In a charging process, the chargers 12 uniformly charge the surfaces of the photoconductors 11Y, 11M, 11C, and 11K at opposing positions at which the chargers 12 oppose the photoconductors 11Y, 11M, 11C, and 11K, respectively. Thus, the photoconductors 11Y, 11M, 11C, and 11K have a charging potential. The charged surfaces of the photoconductors 11Y, 11M, 11C, and 11K reach emission positions at which the writer 2 emits the laser beams L, respectively.

In an exposure process, four light sources of the writer 2 emit the laser beams L corresponding to the yellow, magenta, cyan, and black image data, respectively, which travel on different optical paths from each other.

For example, a laser beam L corresponding to the yellow image data irradiates the surface of the leftmost photoconductor 11Y in FIG. 1. A polygon mirror, which rotates at a high speed, moves the laser beam L corresponding to the yellow image data in an axial direction (e.g., a main scanning direction) of the photoconductor 11Y so as to form an electrostatic latent image corresponding to the yellow image data on the charged surface of the photoconductor 11Y.

Similarly, a laser beam L corresponding to the magenta image data irradiates the surface of the second photoconductor 11M from the left in FIG. 1 to form an electrostatic latent image corresponding to the magenta image data. A laser beam L corresponding to the cyan image data irradiates the surface of the third photoconductor 11C from the left in FIG. 1 to form an electrostatic latent image corresponding to the cyan image data. A laser beam L corresponding to the black image data irradiates the surface of the fourth photoconductor 11K from the left in FIG. 1 to form an electrostatic latent image corresponding to the black image data.

The surfaces of the photoconductors 11Y, 11M, 11C, and 11K bearing the electrostatic latent images corresponding to the yellow, magenta, cyan, and black image data reach opposing positions at which the development devices 13 oppose the photoconductors 11Y, 11M, 11C, and 11K, respectively. In a development process, the development devices 13 supply yellow, magenta, cyan, and black toners to the surfaces of the photoconductors 11Y, 11M, 11C, and 11K to make the electrostatic latent images on the photoconductors 11Y, 11M, 11C, and 11K visible as yellow, magenta, cyan, and black toner images, respectively.

The surfaces of the photoconductors 11Y, 11M, 11C, and 11K bearing the yellow, magenta, cyan, and black toner images reach opposing positions at which the intermediate transfer belt 17 opposes the photoconductors 11Y, 11M, 11C, and 11K, respectively. The first transfer bias rollers 14 contact an inner circumferential surface of the intermediate transfer belt 17 at the opposing positions, respectively. In a first transfer process, the first transfer bias rollers 14 transfer and superimpose the yellow, magenta, cyan, and black toner images formed on the photoconductors 11Y, 11M, 11C, and 11K, respectively, onto an outer circumferential surface of the intermediate transfer belt 17 at the opposing positions, so as to form a color toner image on the intermediate transfer belt 17.

The surfaces of the photoconductors 11Y, 11M, 11C, and 11K, from which the yellow, magenta, cyan, and black toner images have been transferred onto the intermediate transfer belt 17, reach opposing positions at which the cleaners 15 oppose the photoconductors 11Y, 11M, 11C, and 11K, respectively. In a cleaning process, the cleaners 15 collect residual toners not transferred and thereby remaining on the photoconductors 11Y, 11M, 11C, and 11K, respectively.

After the cleaning process, the surfaces of the photoconductors 11Y, 11M, 11C, and 11K pass through dischargers. Thus, a series of image forming processes performed on the photoconductors 11Y, 11M, 11C, and 11K is completed.

One of the feeding rollers 8 feeds a transfer sheet P from one of the paper trays 7 toward the registration roller pair 9 via a conveyance guide. The registration roller pair 9 feeds the transfer sheet P toward a second transfer nip formed between the intermediate transfer belt 17 and the second transfer bias roller 18 at a proper time.

The surface of the intermediate transfer belt 17 bearing the color toner image and rotating clockwise in FIG. 1 reaches an opposing position at which the second transfer bias roller 18 opposes the intermediate transfer belt 17. In a second transfer process, the second transfer bias roller 18 transfers the color toner image formed on the intermediate transfer belt 17 onto the transfer sheet P fed by the registration roller pair 9 at the opposing position.

After the second transfer process, the surface of the intermediate transfer belt 17, from which the color toner image has been transferred onto the transfer sheet P, reaches an opposing position at which the belt cleaner 16 opposes the intermediate transfer belt 17. The belt cleaner 16 collects residual toners not transferred and thereby adhered to the surface of the intermediate transfer belt 17. Thus, a series of transfer processes performed on the intermediate transfer belt 17 is completed.

A conveyance belt conveys the transfer sheet P bearing the color toner image toward the fixing device 20. In the fixing device 20, a fixing belt and a pressing roller are pressed against each other to form a fixing nip between the fixing belt and the pressing roller. At the fixing nip, the fixing belt and the pressing roller fix the color toner image on the transfer sheet P in a fixing process.

After the fixing process, an output roller outputs the transfer sheet P bearing the fixed color toner image onto an outside of the image forming apparatus 1. Thus, a series of image forming operations performed by the image forming apparatus 1 is completed.

Referring to FIGS. 2 to 8, the following describes the image forming devices 6. Since the four image forming devices 6 have a common structure, "Y", "M", "C", and "K" of the reference numerals assigned to the photoconductors 11Y, 11M, 11C, and 11K are hereinafter omitted.

Figure 2:
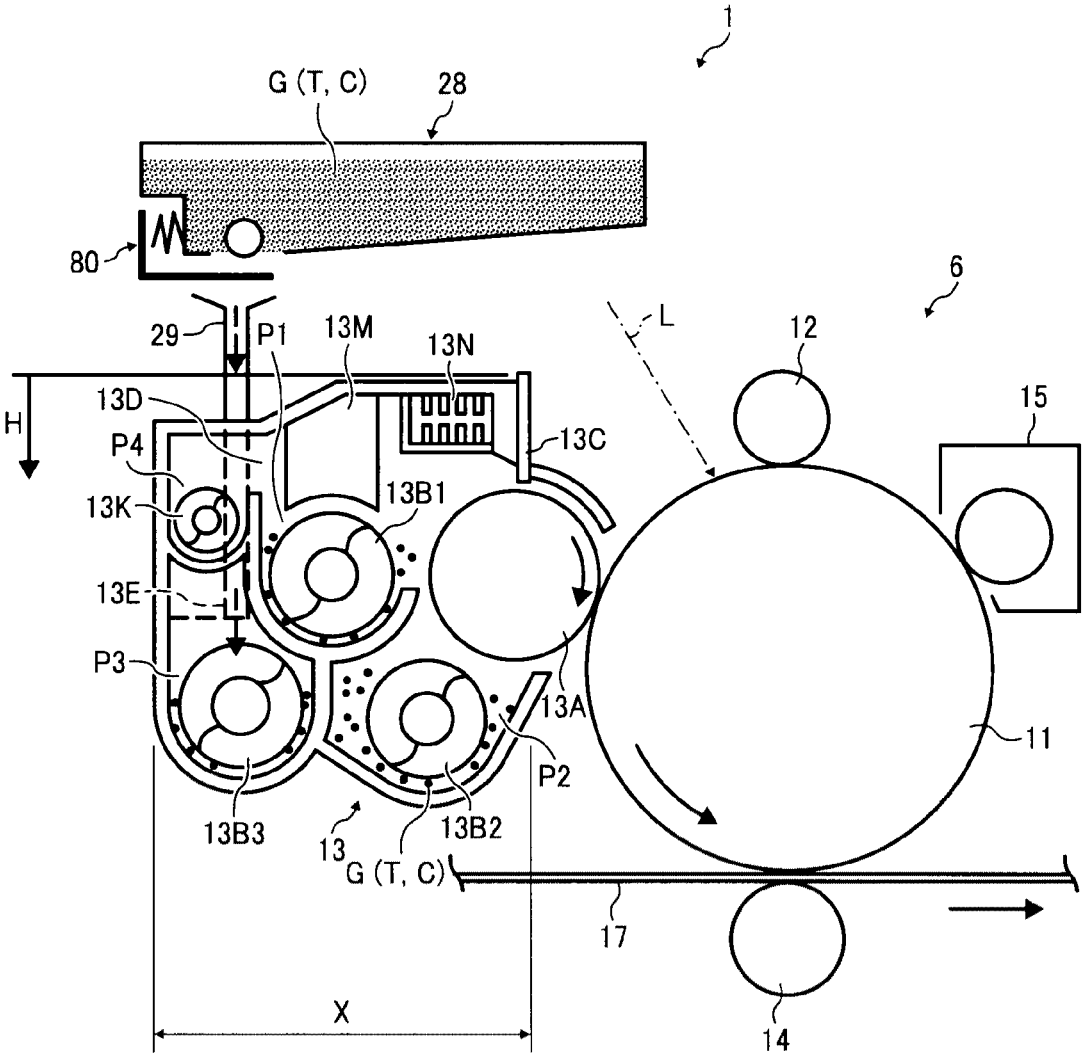
FIG. 2 is a sectional front view of an image forming device and a developer cartridge included in the image forming apparatus shown in FIG. 1.
Figure 3:
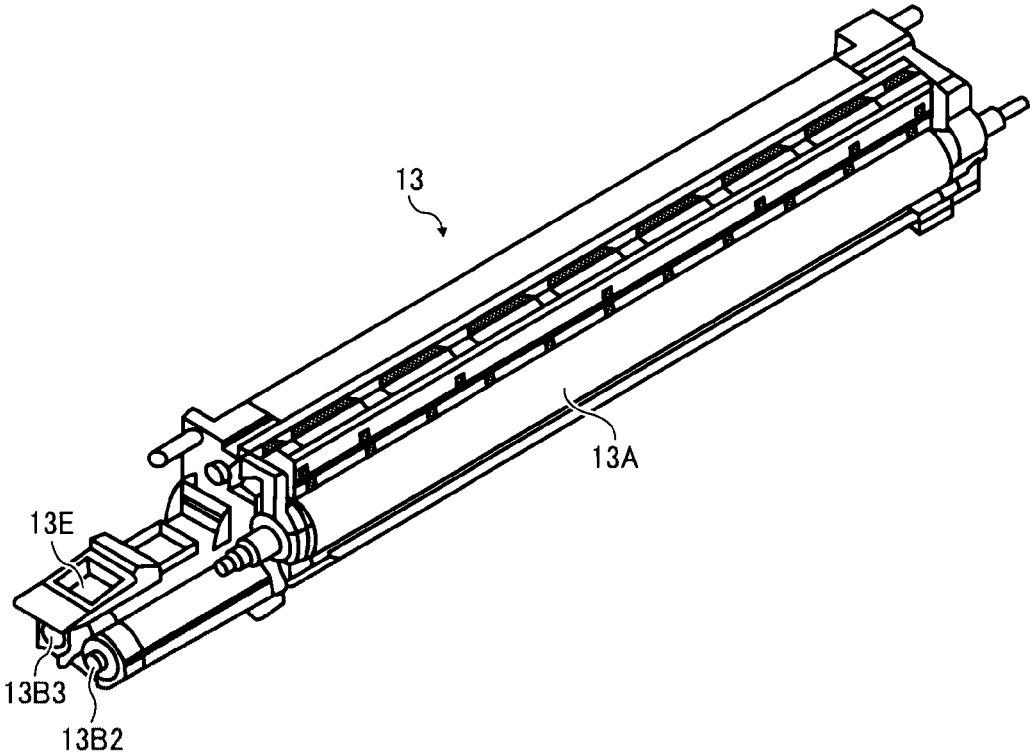
FIG. 3 is a perspective view of a development device included in the image forming device shown in FIG. 2.

FIG. 2 is a sectional front view of the image forming device 6 and the developer cartridge 28. FIG. 3 is a perspective view of the development device 13. As illustrated in FIG. 2, the development device 13 includes a first conveyance screw 13B1, a second conveyance screw 13B2, a third conveyance screw 13B3, a discharge conveyance screw 13K, a first conveyance path P1, a second conveyance path P2, a third conveyance path P3, a discharge conveyance path P4, a development roller 13A, a supply tube 29, an inlet 13E, a doctor blade 13C, a cooler 13N, an outlet 13D, and a ceiling 13M. The developer cartridge 28 includes a shutter mechanism 80.

Figure 4A:
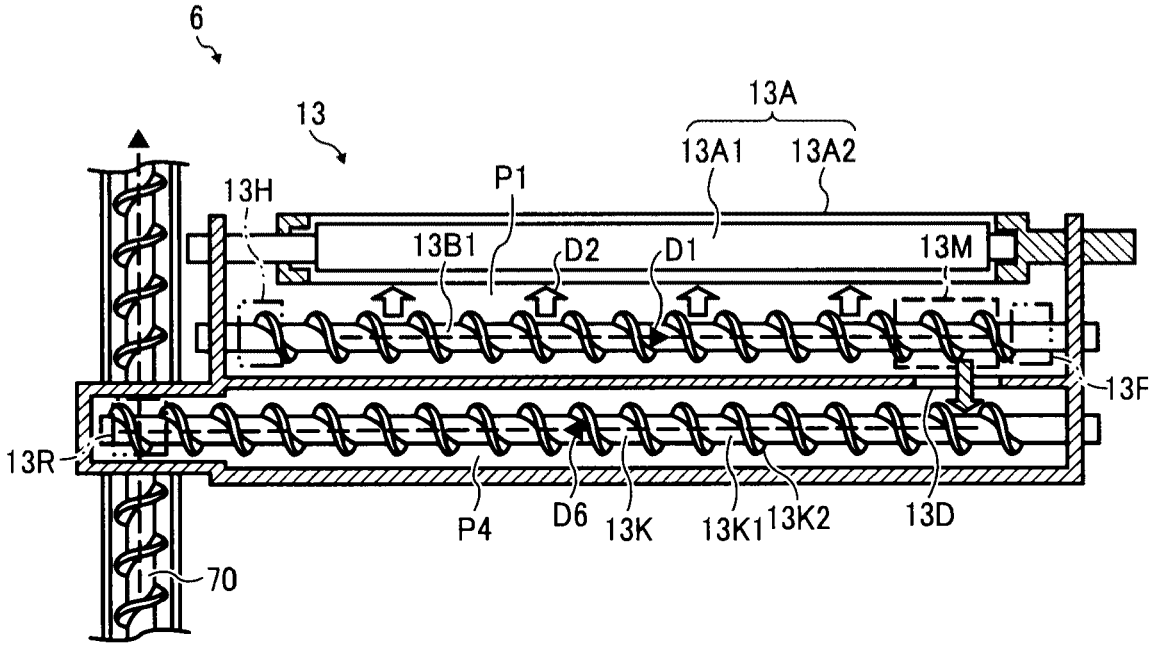
FIG. 4A is a sectional side view of an upper portion of the development device shown in FIG. 3 in a long direction of the development device.
Figure 4B:
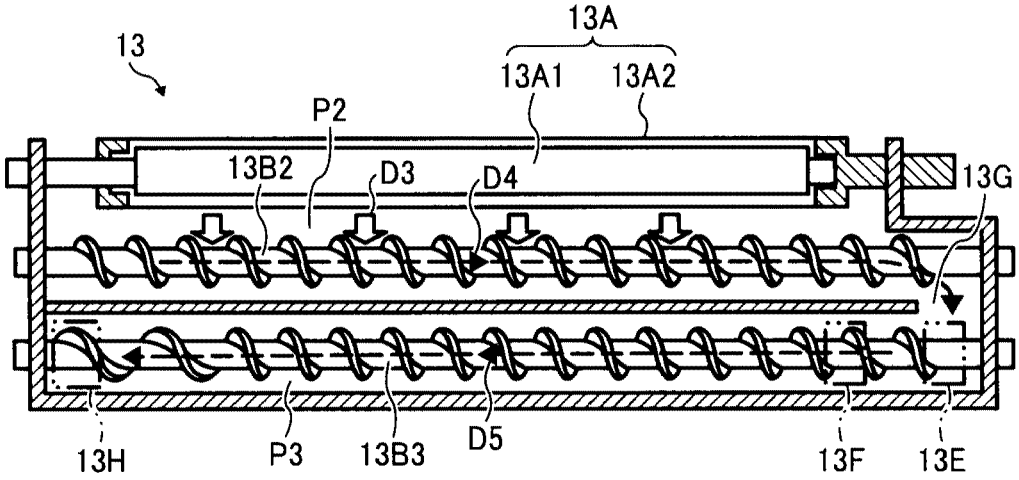
FIG. 4B is a sectional side view of a lower portion of the development device shown in FIG. 3 in the long direction of the development device.

FIG. 4A is a sectional side view of an upper portion of the development device 13 in a long direction of the development device 13. FIG. 4B is a sectional side view of a lower portion of the development device 13 in the long direction of the development device 13. As illustrated in FIG. 4A, the image forming device 6 further includes a discharge path 70. The development device 13 further includes a first transit portion 13F, a third transit portion 13H, and an opening 13R. The development roller 13A includes a magnet 13A1 and a sleeve 13A2. The discharge conveyance screw 13K includes a shaft 13K1 and a screw 13K2. As illustrated in FIG. 4B, the development device 13 further includes a second transit portion 13G.

Figure 5:
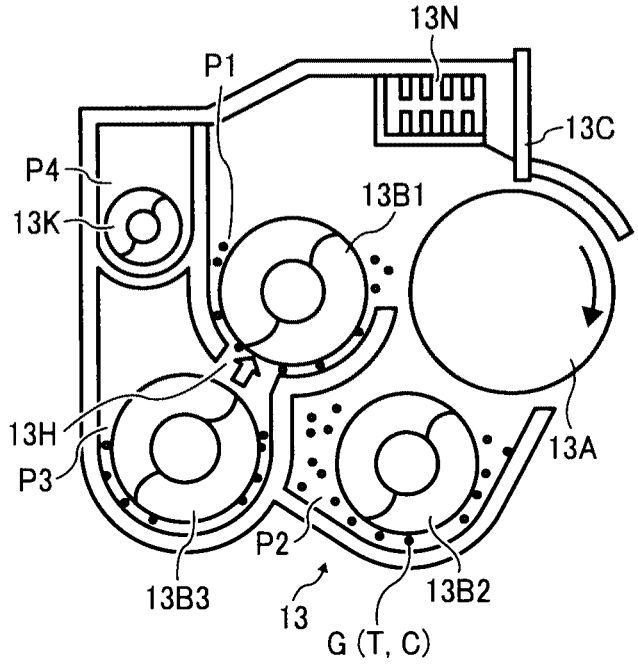
FIG. 5 is a sectional front view of the development device shown in FIG. 4A in cross section near a third transit portion included in the development device.
Figure 6:
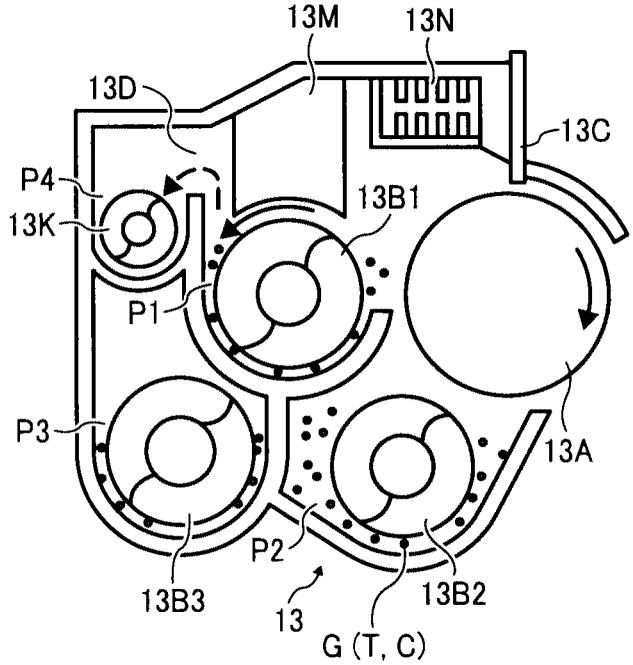
FIG. 6 is a sectional front view of the development device shown in FIG. 4A in cross section near an outlet included in the development device.
Figure 7:
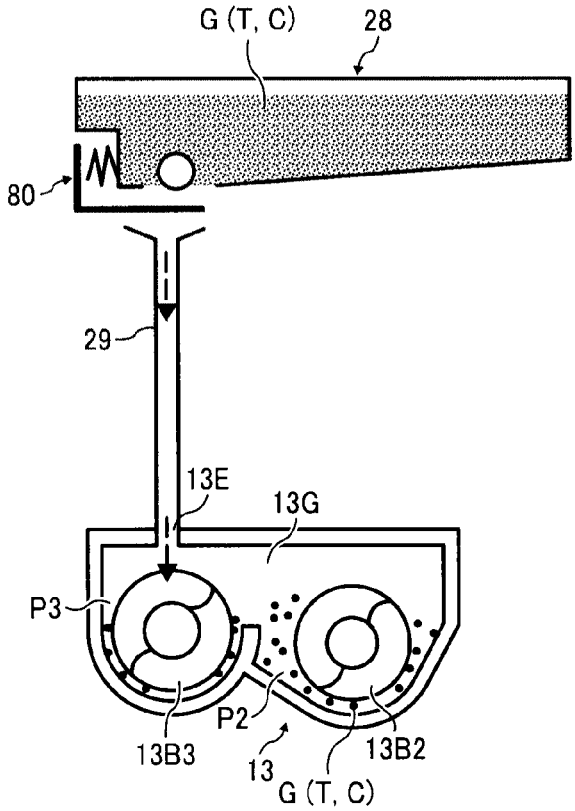
FIG. 7 is a sectional front view of the development device shown in FIG. 3 in cross section near an inlet included in the development device.
Figure 8:
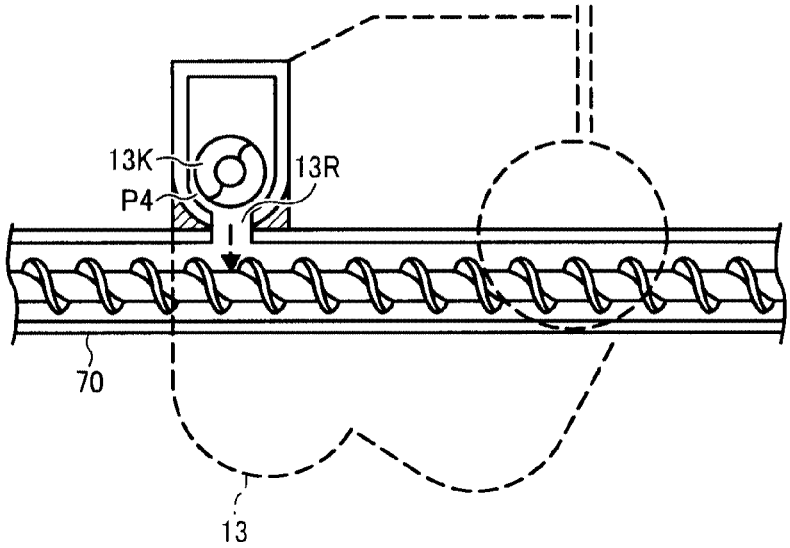
FIG. 8 is a sectional front view of the development device shown in FIG. 4A in cross section near an opening included in the development device.

FIG. 5 is a sectional front view of the development device 13 in cross section near the third transit portion 13H. FIG. 6 is a sectional front view of the development device 13 in cross section near the outlet 13D. FIG. 7 is a sectional front view of the development device 13 in cross section near the inlet 13E. FIG. 8 is a sectional front view of the development device 13 in cross section near the opening 13R.

As illustrated in FIG. 2, the image forming device 6 includes the photoconductor 11 serving as the photoconductor 11Y, 11M, 11C, or 11K depicted in FIG. 1, the charger 12, the development device 13, and the cleaner 15. The photoconductor 11, serving as an image carrier, is an organic photoconductor negatively charged and rotated counterclockwise in FIG. 2 by a driver.

The charger 12 includes an elastic charging roller in which a medium-resistant urethane foam layer, which includes a urethane resin, carbon black serving as a conductive particle, a sulfurizing agent, and a foaming agent, is formed on a core metal. The medium-resistant layer includes urethane, ethylene propylene diene monomer (EPDM), butadiene acrylonitrile rubber (NBR), silicon rubber, a rubber material in which a conductive substance, such as carbon black and metal oxide, is dispersed in isoprene rubber for resistance adjustment, or a material obtained by foaming the above. The cleaner 15 includes a cleaning brush or a cleaning blade for sliding on the photoconductor 11 to mechanically remove and collect residual toner not transferred and thereby remaining on the photoconductor 11 from the photoconductor 11.

In the development device 13, the development roller 13A, serving as a developer carrier, is contacted by or disposed close to the photoconductor 11. The development roller 13A opposes the photoconductor 11 to form a development area between the development roller 13A and the photoconductor 11 in which the photoconductor 11 contacts a magnetic brush formed on the development roller 13A. The development device 13 contains a developer G (e.g., a two-component developer) including toner T and carrier C. The development device 13 develops an electrostatic latent image formed on the photoconductor 11 to form a toner image on the photoconductor 11.

According to this exemplary embodiment, the development device 13 uses a pre-mixed development method. The developer cartridge 28 supplies a fresh developer G containing carrier C to the development device 13. The development device 13 discharges a waste developer G to a waste developer container via the discharge path 70 (depicted in FIG. 4A) provided outside the development device 13.

The developer cartridge 28 contains a developer G containing toner T and carrier C to be supplied to the development device 13. Namely, the developer cartridge 28 functions as a toner cartridge for supplying fresh toner T to the development device 13. The developer cartridge 28 also functions as a supplier for supplying fresh carrier C to the development device 13. Specifically, a shutter driver opens and closes the shutter mechanism 80 based on information about toner density, that is, a rate of the toner T contained in the developer G, detected by a magnetic sensor provided in the development device 13. Thus, the developer cartridge 28 properly supplies the developer G to the development device 13. According to this exemplary embodiment, the toner density, that is, a rate of the toner T mixed with the carrier C in the developer G, is relatively high.

Alternatively, the developer cartridge 28 may supply the developer G to the development device 13 based on information about image density detected by a reflectance of a toner image formed on the photoconductor 11 or the intermediate transfer belt 17, or based on a combination of the above different information.

The supply tube 29 serves as a supplier for guiding the developer G containing the toner T and the carrier C supplied by the developer cartridge 28 to an inside of the development device 13. Specifically, the developer G discharged from the developer cartridge 28 is supplied to the inside of the development device 13 via the supply tube 29 and the inlet 13E.

The following describes the development device 13. As illustrated in FIG. 2, the development device 13 includes the development roller 13A serving as a developer carrier, the first conveyance screw 13B1, the second conveyance screw 13B2, and the third conveyance screw 13B3 (e.g., auger screws) serving as conveyance members, the doctor blade 13C serving as a developer regulating member, and the discharge conveyance screw 13K serving as a discharge conveyance member.

As illustrated in FIG. 4A, the development roller 13A has an outer diameter of about 25 mm and includes the sleeve 13A2 having a tubular shape and including a non-magnetic body, such as aluminum, brass, stainless steel, and a conductive resin. A driver rotates the sleeve 13A2 of the development roller 13A clockwise in FIG. 2. The magnet 13A1 is fixed inside the sleeve 13A2, and generates a magnetic field to ear the developer G on an outer circumferential surface of the sleeve 13A2. For example, the carrier C of the developer G is eared in a chain shape on the sleeve 13A2 along magnetic lines of force generated by the magnet 13A1 in a normal line direction. The charged toner T is adhered to the carrier C eared in the chain shape to form a magnetic brush. The rotating sleeve 13A2 rotates the magnetic brush in a rotating direction (e.g., clockwise in FIG. 2) common to a rotating direction in which the sleeve 13A2 rotates.

As illustrated in FIG. 2, the doctor blade 13C is provided upstream from the development area formed between the development roller 13A and the photoconductor 11 opposing each other in the rotating direction of the development roller 13A, so as to regulate the developer G on the development roller 13A.

The cooler 13N is provided near the doctor blade 13C, and has a hollow structure in which a plurality of fins is provided inside the cooler 13N. A fan sends air to an inside of the cooler 13N to cool the doctor blade 13C including a metal material or reduce temperature increase of the doctor blade 13C. Accordingly, the toner T is not adhered and fixed to the doctor blade 13C and the development roller 13A.

The three screws, which are the first conveyance screw 13B1, the second conveyance screw 13B2, and the third conveyance screw 13B3, agitate and mix the developer G contained in the development device 13 while circulating the developer G in a long direction of the first conveyance screw 13B1, the second conveyance screw 13B2, and the third conveyance screw 13B3, that is, the long direction of the development device 13.

The first conveyance screw 13B1, serving as a first conveyance member, opposes the development roller 13A and conveys the developer G horizontally in the long direction (e.g., an axial direction) of the first conveyance screw 13B1, specifically, a direction D1 shown by a rightward arrow illustrated in a broken line in FIG. 4A. Simultaneously, the first conveyance screw 13B1 supplies the developer G onto the development roller 13A in a direction D2 shown by an upward arrow in FIG. 4A.

The second conveyance screw 13B2, serving as a second conveyance member, is provided at a position below or lower than the first conveyance screw 13B1 to oppose the development roller 13A. After a development process, a polarity for separating the developer G from the development roller 13A forcibly separates the developer G from the development roller 13A in a direction D3 shown by a downward arrow in FIG. 4B. The second conveyance screw 13B2 conveys the developer G separated from the development roller 13A horizontally in the long direction of the second conveyance screw 13B2, specifically, a direction D4 shown by a rightward arrow illustrated in a broken line in FIG. 4B.

The third conveyance screw 13B3, serving as a third conveyance member, is provided at a position adjacent to the second conveyance screw 13B2 and obliquely below the first conveyance screw 13B1. The third conveyance screw 13B3 conveys the developer G conveyed from the second conveyance screw 13B2 to an upstream portion of the first conveyance path P1 formed by the first conveyance screw 13B1. Simultaneously, the third conveyance screw 13B3 conveys and circulates the developer G sent from a downstream portion of the first conveyance path P1 formed by the first conveyance screw 13B1 via the first transit portion 13F to the upstream portion of the first conveyance path P1 formed by the first conveyance screw 13B1 in a direction D5 shown by a leftward arrow illustrated in a broken line in FIG. 4B.

Rotary shafts of the first conveyance screw 13B1, the second conveyance screw 13B2, and the third conveyance screw 13B3 are provided substantially in a horizontal direction, like rotary shafts of the development roller 13A and the photoconductor 11. In each of the first conveyance screw 13B1, the second conveyance screw 13B2, and the third conveyance screw 13B3, a screw is wound around the rotary shaft in a spiral shape. The screw has an outer diameter of about 22 mm.

The first conveyance path P1 formed by the first conveyance screw 13B1, the second conveyance path P2 formed by the second conveyance screw 13B2, the third conveyance path P3 formed by the third conveyance screw 13B3, and the discharge conveyance path P4 formed by the discharge conveyance screw 13K are separated from each other via walls.

As illustrated in FIG. 4B, a downstream portion of the second conveyance path P2 formed by the second conveyance screw 13B2 and an upstream portion of the third conveyance path P3 formed by the third conveyance screw 13B3 are connected via the second transit portion 13G. As illustrated in FIGS. 4A and 4B, the downstream portion of the first conveyance path P1 formed by the first conveyance screw 13B1 and the upstream portion of the third conveyance path P3 formed by the third conveyance screw 13B3 are connected via the first transit portion 13F. As illustrated in FIGS. 4A, 4B, and 5, a downstream portion of the third conveyance path P3 formed by the third conveyance screw 13B3 and the upstream portion of the first conveyance path P1 formed by the first conveyance screw 13B1 are connected via the third transit portion 13H. As illustrated in FIG. 5, the developer G accumulated near the third transit portion 13H in the third conveyance path P3 formed by the third conveyance screw 13B3 is conveyed (e.g., supplied) to the upstream portion of the first conveyance path P1 formed by the first conveyance screw 13B1 via the third transit portion 13H.

Thus, the first conveyance screw 13B1, the second conveyance screw 13B2, and the third conveyance screw 13B3 form a circulation path for circulating the developer G in the development device 13 in the long direction of the first conveyance screw 13B1, the second conveyance screw 13B2, and the third conveyance screw 13B3, that is, the long direction of the development device 13. Namely, when the development device 13 is driven, the developer G contained in the development device 13 moves in the directions D1 (depicted in FIG. 4A), D4, and D5 (depicted in FIG. 4B). A supply path for supplying the developer G to the development roller 13A (e.g., the first conveyance path P1 formed by the first conveyance screw 13B1) separates from a collecting path for collecting the developer G separated from the development roller 13A (e.g., the second conveyance path P2 formed by the second conveyance screw 13B2), reducing density deviation of a toner image formed on the photoconductor 11 depicted in FIG. 2.

A magnetic sensor is provided in the third conveyance path P3 formed by the third conveyance screw 13B3, and detects toner density of the developer G circulated in the development device 13. The developer cartridge 28 (depicted in FIG. 2) supplies the developer G having a predetermined toner density to the development device 13 via the inlet 13E (depicted in FIG. 2) based on information about toner density detected by the magnetic sensor.

As illustrated in FIGS. 3, 4B, and 7, the inlet 13E is provided above the upstream portion of the third conveyance path P3 formed by the third conveyance screw 13B3 at a position away from the development area between the development roller 13A and the photoconductor 11 (depicted in FIG. 2), that is, outside a long length of the development roller 13A.

As illustrated in FIGS. 2, 4A, and 6, the outlet 13D is provided on a wall of the first conveyance path P1 formed by the first conveyance screw 13B1, and discharges a part of the developer G contained in the development device 13 to an outside of the first conveyance path P1 formed by the first conveyance screw 13B1.

Specifically, when a top surface of the developer G supplied by the developer cartridge 28 including the shutter mechanism 80 and the supply tube 29 to the inside of the development device 13 exceeds a predetermined height due to increase in an amount of the developer G contained in the development device 13, the outlet 13D, serving as a discharge member, discharges surplus developer G to the discharge conveyance path P4 formed by the discharge conveyance screw 13K. The discharge conveyance screw 13K conveys the developer G discharged from the outlet 13D in a long direction of the discharge conveyance screw 13K, specifically, a direction D6 shown by a leftward arrow illustrated in a broken line in FIG. 4A. As illustrated in FIG. 8, the conveyed developer G falls under its own weight from the discharge conveyance screw 13K via the opening 13R to the discharge path 70 provided outside the development device 13, and is conveyed to the waste developer container via the discharge path 70. Namely, when the surplus developer G overflows a lower wall of the outlet 13D, the surplus developer G is discharged from the outlet 13D and conveyed toward the waste developer container via the discharge conveyance path P4 formed by the discharge conveyance screw 13K and the discharge path 70. Accordingly, carrier C contaminated and deteriorated by a mother resin of the toner T and an additive is automatically discharged to the outside of the development device 13, preventing deterioration of toner image quality over time. The discharge path 70 is connected to the discharge conveyance paths P4 formed by the discharge conveyance screws 13K of the four development devices 13 (depicted in FIG. 1). The waste developer container collects the surplus developer G sent from the four development devices 13.

As illustrated in FIG. 2, the discharge conveyance path P4 formed by the discharge conveyance screw 13K is provided within a length X in which the circulation path formed by the first conveyance screw 13B1, the second conveyance screw 13B2, and the third conveyance screw 13B3 is provided in the horizontal direction perpendicular to the long direction (e.g., the axial direction) of the first conveyance screw 13B1, the second conveyance screw 13B2, and the third conveyance screw 13B3. For example, the discharge conveyance path P4 formed by the discharge conveyance screw 13K does not protrude leftward from the third conveyance path P3 formed by the third conveyance screw 13B3. In other words, the discharge conveyance path P4 formed by the discharge conveyance screw 13K does not protrude from a side wall (e.g., a left wall in FIG. 2) of the development device 13.

The above-described structure of the development device 13 prevents the development device 13 from occupying a large space in a short direction X, that is, the horizontal direction perpendicular to the long direction of the development device 13. Thus, as illustrated in FIG. 1, even when a plurality of development devices 13 is provided in the tandem-type image forming apparatus 1, a relatively short distance is provided between the adjacent image forming devices 6, preventing the image forming apparatus 1 from having a large size.

The discharge conveyance path P4 formed by the discharge conveyance screw 13K is provided at a position higher than a bottom of the development device 13. Therefore, as illustrated in FIG. 8, the discharge path 70 provided outside the development device 13 and connected to the development device 13 can be provided at a position higher than the bottom of the development device 13. The developer G falls under its own weight from the opening 13R provided in the discharge conveyance path P4 formed by the discharge conveyance screw 13K. Accordingly, as illustrated in FIG. 1, the discharge path 70 does not interfere with the intermediate transfer belt 17 provided below the development device 13. As a result, the image forming apparatus 1 can have a small size in a long direction of the image forming apparatus 1.

As illustrated in FIG. 2, the discharge conveyance path P4 formed by the discharge conveyance screw 13K is provided at a position not higher than an upper end of the doctor blade 13C in a vertical direction (e.g., a direction H). Thus, even when the discharge conveyance path P4 formed by the discharge conveyance screw 13K is provided within the length X, the development device 13 does not have a large size in the vertical direction (e.g., a height direction).

A center of rotation of the discharge conveyance screw 13K is provided at a position higher than a center of rotation of the first conveyance screw 13B1. Accordingly, the discharge conveyance path P4 formed by the discharge conveyance screw 13K can be provided within the length X easily. Further, an excessive amount of the developer G may not be discharged from the outlet 13D because the center of rotation of the discharge conveyance screw 13K is not provided at a position lower than the center of rotation of the first conveyance screw 13B1.

In order to prevent the outlet 13D from discharging an insufficient amount of the developer G when the center of rotation of the discharge conveyance screw 13K is provided at the position higher than the center of rotation of the first conveyance screw 13B1, the first conveyance path P1 formed by the first conveyance screw 13B1 includes the ceiling 13M provided at a position near the outlet 13D and above and adjacent to the first conveyance screw 13B1. As illustrated in FIGS. 2, 4A, and 6, in order to reduce a space between the ceiling 13M and the first conveyance screw 13B1 opposing each other, which is formed above the first conveyance screw 13B1 and near the outlet 13D, the ceiling 13M includes an opposing surface for opposing the first conveyance screw 13B1, which has an arc-like shape corresponding to an outer diametrical shape of the screw of the first conveyance screw 13B1. The space between the ceiling 13M and the first conveyance screw 13B1 reduced by the ceiling 13M increases height of the top surface of the developer G near the outlet 13D. Accordingly, surplus developer G overflows the outlet 13D provided at a position higher than the center of rotation of the first conveyance screw 13B1. The size, for example, height and length in the long direction of the first conveyance screw 13B1, of the space between the ceiling 13M and the first conveyance screw 13B1 may be determined based on an experimental result, so that a proper amount of the developer G is discharged from the outlet 13D.

As illustrated in FIG. 4A, the discharge conveyance screw 13K includes the shaft 13K1 and the screw 13K2. The shaft 13K1 extends in the long direction of the discharge conveyance screw 13K and has an outer diameter of about 2 mm. The screw 13K2 is wound around the shaft 13K1 in a spiral shape. The screw 13K2 has an outer diameter of about 8 mm. Both ends of the screw 13K2 in the long direction of the discharge conveyance screw 13K are welded to the shaft 13K1, reducing manufacturing costs of the discharge conveyance screw 13K. A center of the screw 13K2 in the long direction of the discharge conveyance screw 13K can be flexibly screwed, releasing load applied to the screw 13K2 easily.

Like the first conveyance screw 13B1, the second conveyance screw 13B2, and the third conveyance screw 13B3, the shaft 13K1 of the discharge conveyance screw 13K is provided substantially in the horizontal direction. One end (e.g., a right end in FIG. 4A) of the discharge conveyance screw 13K in the long direction of the discharge conveyance screw 13K is rotatably supported. Another end (e.g., a left end in FIG. 4A) of the discharge conveyance screw 13K in the long direction of the discharge conveyance screw 13K is a free end.

A one-way clutch connected to an end (e.g., the right end in FIG. 4A) of the shaft 13K1 of the discharge conveyance screw 13K, which contacts a cam connected to the rotary shaft of the first conveyance screw 13B1, rotates the discharge conveyance screw 13K intermittently at a relatively low speed. In this case, the discharge conveyance screw 13K rotates while contacting walls (e.g., a bottom wall and a side wall) of the discharge conveyance path P4 formed by the discharge conveyance screw 13K, because another end of the discharge conveyance screw 13K is the free end. Accordingly, a space between the discharge conveyance screw 13K and the walls of the discharge conveyance path P4 is reduced, preventing the developer G from being accumulated in the discharge conveyance path P4. In other words, a dead space is not formed between the discharge conveyance screw 13K and the walls of the discharge conveyance path P4. As described above, the discharge conveyance screw 13K rotates intermittently at a relatively low speed. Therefore, even when the discharge conveyance screw 13K contacts the walls of the discharge conveyance path P4 while rotating, the discharge conveyance screw 13K may not generate unusual noise and may not apply a heavy load.

As illustrated in FIG. 2, according to this exemplary embodiment, the discharge conveyance path P4 formed by the discharge conveyance screw 13K is provided at the position within the length X in which the circulation path formed by the plurality of the first conveyance screw 13B1, the second conveyance screw 13B2, and the third conveyance screw 13B3 is provided in the horizontal direction perpendicular to the long direction of the plurality of the first conveyance screw 13B1, the second conveyance screw 13B2, and the third conveyance screw 13B3. Thus, the development device 13 using the pre-mixed development method can have a decreased size.

According to this exemplary embodiment, the outlet 13D is provided in the first conveyance path P1 formed by the first conveyance screw 13B1, and the inlet 13E is provided in the third conveyance path P3 formed by the third conveyance screw 13B3. Alternatively, the outlet 13D and the inlet 13E may be provided at other positions, respectively.

Moreover, according to this exemplary embodiment, the third conveyance screw 13B3 is provided in the horizontal direction. Alternatively, the third conveyance screw 13B3 may be provided in a direction oblique to the horizontal direction.

Figure 9:
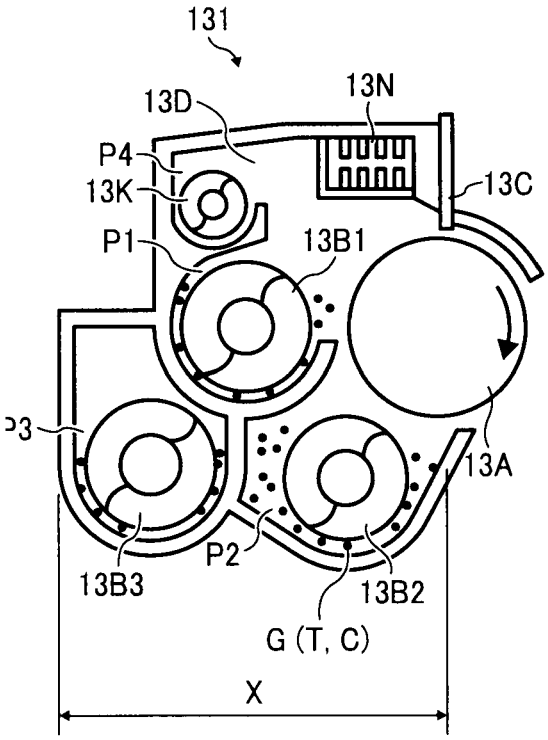
FIG. 9 is a sectional front view of a development device according to another exemplary embodiment of the present invention.

Referring to FIG. 9, the following describes a development device 131 according to another exemplary embodiment. FIG. 9 is a sectional front view of the development device 131 comparable with the development device 13 depicted in FIG. 6. The development device 131 is different from the development device 13 because the discharge conveyance screw 13K is provided directly above the first conveyance screw 13B1.

Like the development device 13 depicted in FIG. 6, the development device 131 uses the pre-mixed development method. The development device 131 includes the elements common to the development device 13. For example, the development device 131 includes the development roller 13A serving as a developer carrier, the first conveyance screw 13B1, the second conveyance screw 13B2, the third conveyance screw 13B3 serving as conveyance members, the doctor blade 13C serving as a developer regulating member, the discharge conveyance screw 13K serving as a discharge conveyance member, the first conveyance path P1, the second conveyance path P2, the third conveyance path P3, the discharge conveyance path P4, the outlet 13D, and the cooler 13N. The discharge conveyance path P4 formed by the discharge conveyance screw 13K is provided within the length X in which the circulation path formed by the first conveyance screw 13B1, the second conveyance screw 13B2, and the third conveyance screw 13B3 is provided in the horizontal direction perpendicular to the long direction of the first conveyance screw 13B1, the second conveyance screw 13B2, and the third conveyance screw 13B3.

For example, the discharge conveyance path P4 formed by the discharge conveyance screw 13K does not protrude leftward from the first conveyance path P1 formed by the first conveyance screw 13B1. In other words, the discharge conveyance path P4 formed by the discharge conveyance screw 13K in the development device 131 is provided at a position closer to the development roller 13A or the photoconductor 11 (depicted in FIG. 2) than in the development device 13 (depicted in FIG. 6).

The discharge conveyance path P4 formed by the discharge conveyance screw 13K is provided at a position not higher than an upper end of the doctor blade 13C in the vertical direction. Thus, like the development device 13, the development device 131 can have a compact size in the short direction X, a long direction, and a height direction of the development device 131.

In order to discharge surplus developer G from the outlet 13D provided above the first conveyance screw 13B1 properly, the ceiling 13M (depicted in FIG. 6) may be provided above the first conveyance screw 13B1, like in the development device 13.

According to this exemplary embodiment, the discharge conveyance path P4 formed by the discharge conveyance screw 13K is provided at the position within the length X in which the circulation path formed by the plurality of the first conveyance screw 13B1, the second conveyance screw 13B2, and the third conveyance screw 13B3 is provided in the horizontal direction perpendicular to the long direction of the plurality of the first conveyance screw 13B1, the second conveyance screw 13B2, and the third conveyance screw 13B3. Thus, the development device 131 using the pre-mixed development method can have a decreased size.

Figure 10:
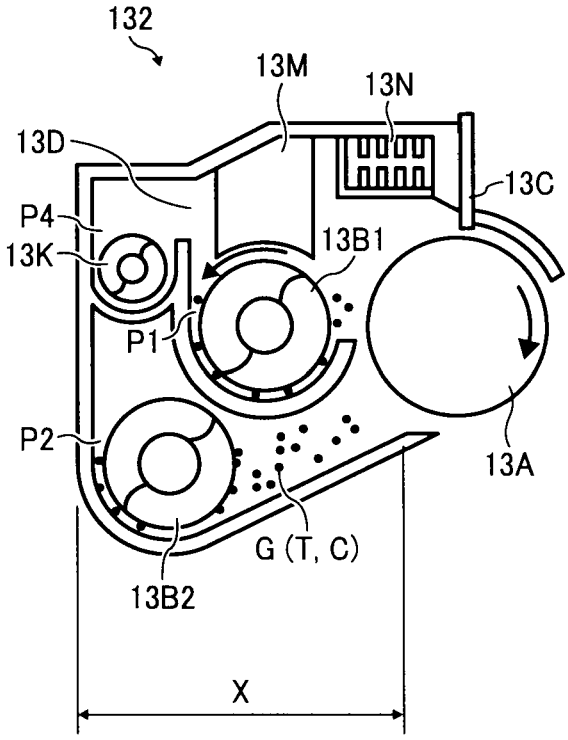
FIG. 10 is a sectional front view of a development device according to yet another exemplary embodiment of the present invention.

Referring to FIG. 10, the following describes a development device 132 according to yet another exemplary embodiment. FIG. 10 is a sectional front view of the development device 132 comparable with the development device 13 depicted in FIG. 6. The development device 132 includes two conveyance members, which are the first conveyance screw 13B1 and the second conveyance screw 13B2, and does not include the third conveyance screw 13B3. The other elements of the development device 132 are common to the development device 13 depicted in FIG. 6.

The development device 132 uses the pre-mixed development method. The development device 132 includes the development roller 13A serving as a developer carrier, the first conveyance screw 13B1 and the second conveyance screw 13B2 serving as conveyance members, the doctor blade 13C serving as a developer regulating member, the discharge conveyance screw 13K serving as a discharge conveyance member, the first conveyance path P1, the second conveyance path P2, the discharge conveyance path P4, the outlet 13D, the ceiling 13M, and the cooler 13N.

In the development device 132, the first conveyance screw 13B1 and the second conveyance screw 13B2 form a circulation path for circulating a developer G contained in the development device 132 in the long direction of the first conveyance screw 13B1 and the second conveyance screw 13B2, that is, a long direction of the development device 132. Specifically, the first conveyance screw 13B1 opposes the development roller 13A to convey a developer G in the long direction (e.g., an axial direction) of the first conveyance screw 13B1 and to supply the developer G onto the development roller 13A. The second conveyance screw 13B2 is provided at a position obliquely below the first conveyance screw 13B1 to convey the developer G separated from the development roller 13A to an upstream portion of the first conveyance path P1 formed by the first conveyance screw 13B1. The second conveyance screw 13B2 also receives the developer G conveyed to a downstream portion of the first conveyance path P1 formed by the first conveyance screw 13B1 to convey the developer G to the upstream portion of the first conveyance path P1 formed by the first conveyance screw 13B1.

The discharge conveyance path P4 formed by the discharge conveyance screw 13K is provided within the length X in which the circulation path formed by the first conveyance screw 13B1 and the second conveyance screw 13B2 is provided in the horizontal direction perpendicular to the long direction of the first conveyance screw 13B1 and the second conveyance screw 13B2. For example, the discharge conveyance path P4 formed by the discharge conveyance screw 13K does not protrude leftward from the second conveyance path P2 formed by the second conveyance screw 13B2. Further, the discharge conveyance path P4 formed by the discharge conveyance screw 13K is provided at a position not higher than an upper end of the doctor blade 13C in the vertical direction. Thus, like the development device 13 depicted in FIG. 6 and the development device 131 depicted in FIG. 9, the development device 132 can have a compact size in the short direction X, a long direction, and a height direction of the development device 132.

According to this exemplary embodiment, like in the development device 13 depicted in FIG. 6 and the development device 131 depicted in FIG. 9, the discharge conveyance path P4 formed by the discharge conveyance screw 13K is provided at the position within the length X in which the circulation path formed by the plurality of the first conveyance screw 13B1 and the second conveyance screw 13B2 is provided in the horizontal direction perpendicular to the long direction of the plurality of the first conveyance screw 13B1 and the second conveyance screw 13B2. Thus, the development device 132 using the pre-mixed development method can have a decreased size.

Figure 11:
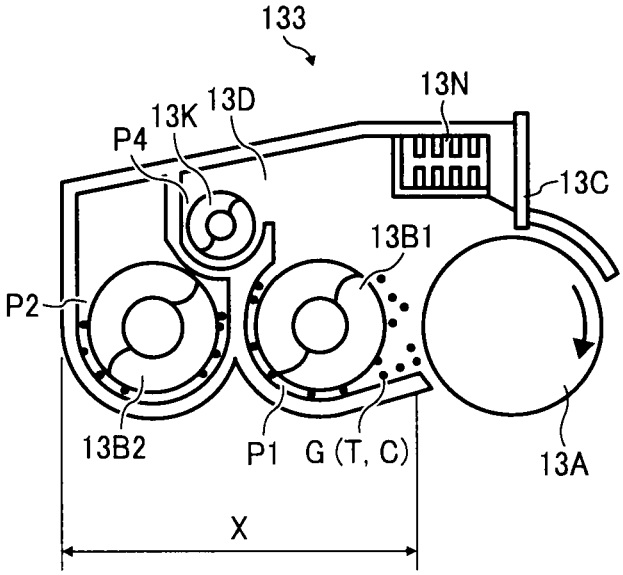
FIG. 11 is a sectional front view of a development device according to yet another exemplary embodiment of the present invention.

Referring to FIG. 11, the following describes a development device 133 according to yet another exemplary embodiment. FIG. 11 is a sectional front view of the development device 133 comparable with the development device 132 depicted in FIG. 10. In the development device 133, the first conveyance screw 13B1 and the second conveyance screw 13B2 are provided side by side in the horizontal direction, while the first conveyance screw 13B1 and the second conveyance screw 13B2 are provided parallel to each other substantially in the vertical direction in the development device 132 depicted in FIG. 10. The other elements of the development device 133 are common to the development device 132.

The development device 133 uses the pre-mixed development method. The development device 133 includes the development roller 13A serving as a developer carrier, the first conveyance screw 13B1 and the second conveyance screw 13B2 serving as conveyance members, the doctor blade 13C serving as a developer regulating member, the discharge conveyance screw 13K serving as a discharge conveyance member, the first conveyance path P1, the second conveyance path P2, the discharge conveyance path P4, the outlet 13D, and the cooler 13N. The two conveyance members, which are the first conveyance screw 13B1 and the second conveyance screw 13B2, form a circulation path for circulating a developer G contained in the development device 133 in the long direction of the first conveyance screw 13B1 and the second conveyance screw 13B2, that is, the long direction of the development device 133.

Specifically, the first conveyance screw 13B1 opposes the development roller 13A to convey a developer G in the long direction (e.g., the axial direction) of the first conveyance screw 13B1 and to supply the developer G onto the development roller 13A. The first conveyance screw 13B1 also collects the developer G separated from the development roller 13A and conveys the collected developer G to a downstream portion of the first conveyance path P1 formed by the first conveyance screw 13B1. The second conveyance screw 13B2 is provided beside the first conveyance screw 13B1 to receive the developer G conveyed to the downstream portion of the first conveyance path P1 formed by the first conveyance screw 13B1 and to convey the developer G to an upstream portion of the first conveyance path P1 formed by the first conveyance screw 13B1.

The discharge conveyance path P4 formed by the discharge conveyance screw 13K is provided within the length X in which the circulation path formed by the first conveyance screw 13B1 and the second conveyance screw 13B2 is provided in the horizontal direction perpendicular to the long direction of the first conveyance screw 13B1 and the second conveyance screw 13B2. For example, the discharge conveyance path P4 formed by the discharge conveyance screw 13K is provided at a position obliquely rightward from and above the second conveyance path P2 formed by the second conveyance screw 13B2 in FIG. 11. Further, the discharge conveyance path P4 formed by the discharge conveyance screw 13K is provided at a position not higher than an upper end of the doctor blade 13C in the vertical direction. Thus, like the development device 13 depicted in FIG. 6, the development device 131 depicted in FIG. 9, and the development device 132 depicted in FIG. 10, the development device 133 can have a compact size in the short direction X, a long direction, and a height direction of the development device 133.

According to this exemplary embodiment, like in the development devices 13, 131, and 132, the discharge conveyance path P4 formed by the discharge conveyance screw 13K is provided at the position within the length X in which the circulation path formed by the plurality of the first conveyance screw 13B1 and the second conveyance screw 13B2 is provided in the horizontal direction perpendicular to the long direction of the plurality of the first conveyance screw 13B1 and the second conveyance screw 13B2. Thus, the development device 133 using the pre-mixed development method can have a decreased size.

According to the above-described exemplary embodiments, the developer cartridge 28 depicted in FIG. 2, serving as a supplier, supplies a developer G containing toner T and carrier C to the development device 13 depicted in FIG. 2, the development device 131 depicted in FIG. 9, the development device 132 depicted in FIG. 10, or the development device 133 depicted in FIG. 11. Alternatively, a supplier may supply only carrier C to the development device 13, 131, 132, or 133. For example, a toner cartridge containing toner T is provided separately from a carrier cartridge containing carrier C. The toner cartridge supplies the toner T to the development device 13, 131, 132, or 133 based on a detection result provided by a magnetic sensor disposed in the development device 13, 131, 132, or 133, providing effects equivalent to the effects provided by the development device 13, 131, 132, or 133.

According to the above-described exemplary embodiments, the development device 13, 131, 132, or 133 serves as a unit attachable to and detachable from the image forming apparatus 1 depicted in FIG. 1. Alternatively, an image forming device may serve as a process cartridge attachable to and detachable from an image forming apparatus, as illustrated in FIGS. 12A and 12B.

Figure 12A:
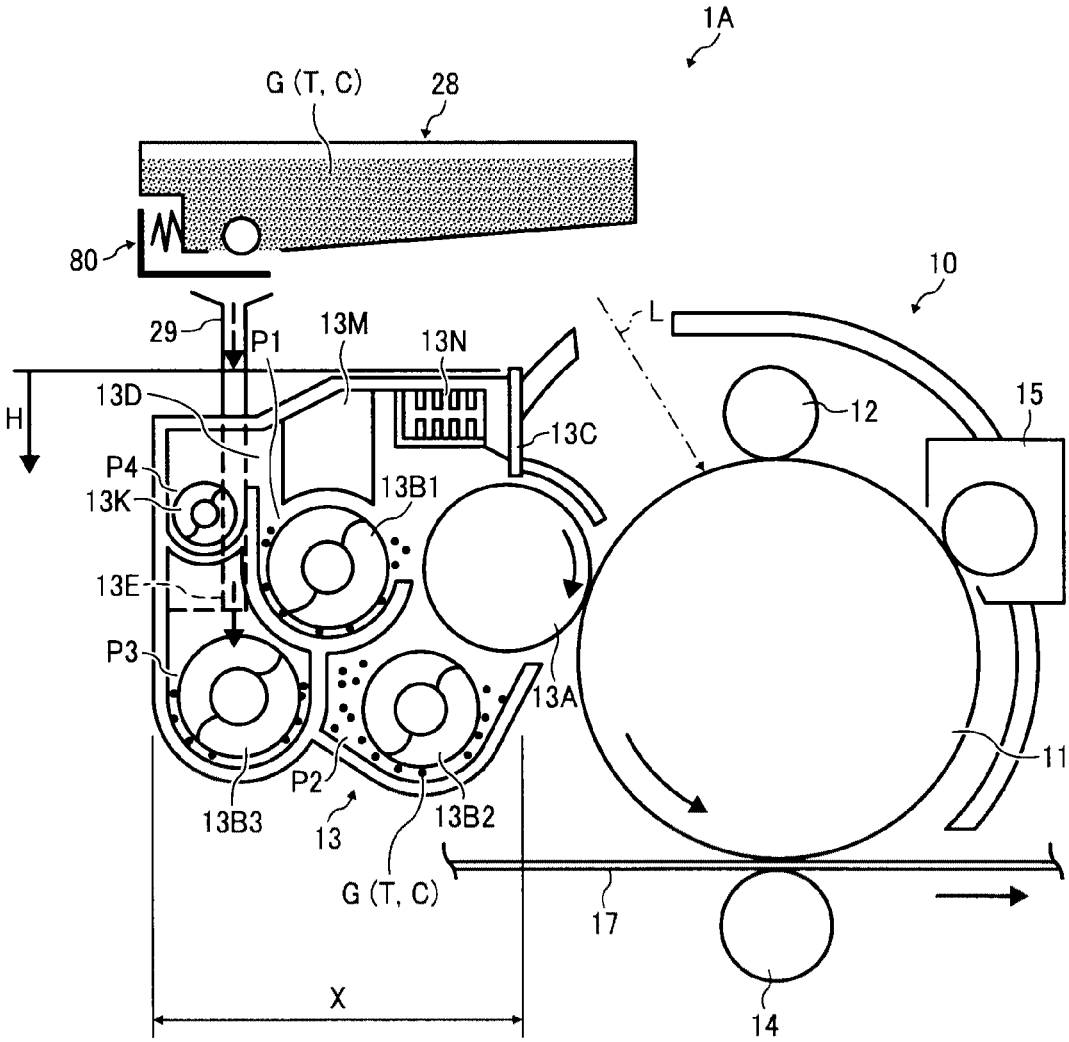
FIG. 12A is a sectional front view of an image forming apparatus according to yet another exemplary embodiment of the present invention.

Referring to FIG. 12A, the following describes an image forming apparatus 1A according to yet another exemplary embodiment. FIG. 12A is a sectional front view of the image forming apparatus 1A. The image forming apparatus 1A includes a process cartridge 10 instead of the image forming device 6 depicted in FIG. 2. The other elements of the image forming apparatus 1A are common to the image forming apparatus 1 depicted in FIG. 2.

The process cartridge 10 serves as a unit into which the photoconductor 11, the charger 12, the development device 13, and the cleaner 15 are integrated inside a case. In other words, an image forming device of the image forming apparatus 1A is formed in a unit serving as the process cartridge 10.

Figure 12B:
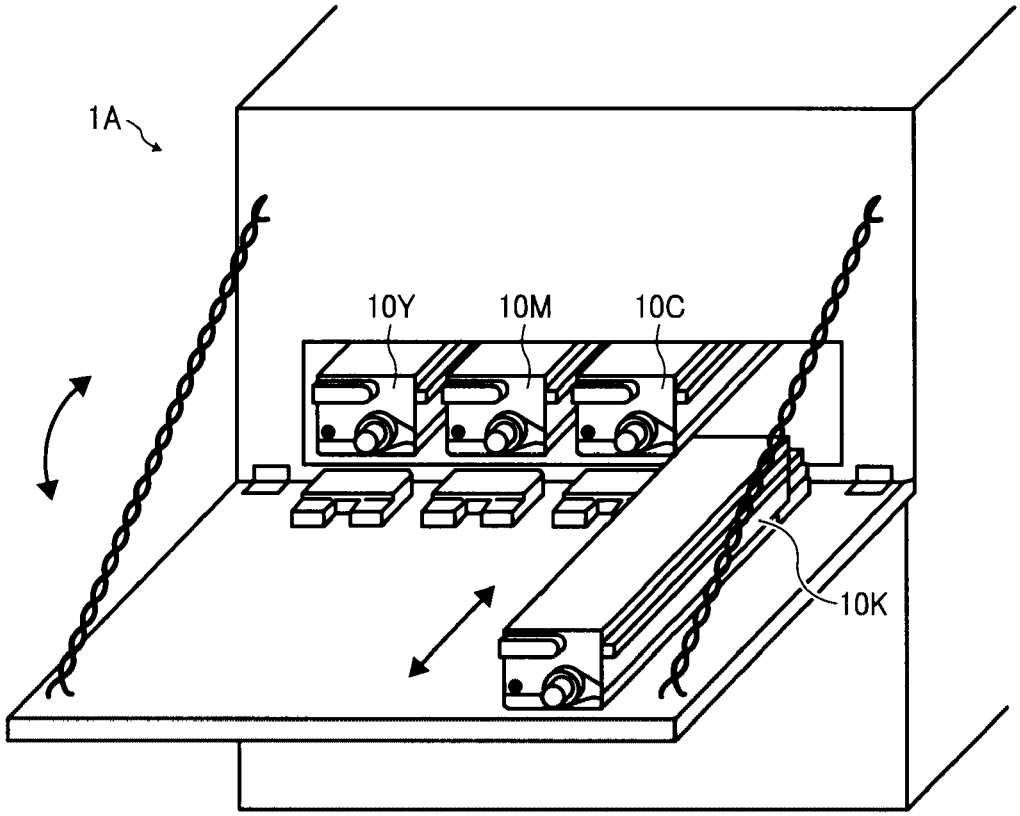
FIG. 12B is a partial perspective view of the image forming apparatus shown in FIG. 12A.

FIG. 12B is a partial perspective view of the image forming apparatus 1A. The image forming apparatus 1A includes process cartridges 10Y, 10M, 10C, and 10K, each of which serves as the process cartridge 10 depicted in FIG. 12A and is attachable to and detachable from the image forming apparatus 1A for replacement or maintenance. As illustrated in FIG. 12A, when the image forming device of the image forming apparatus 1A is partially or wholly formed in the process cartridge 10, the image forming device can provide improved maintenance efficiency. According to this exemplary embodiment, the process cartridge 10 includes the photoconductor 11, the charger 12, the development device 13, and the cleaner 15. Alternatively, the process cartridge 10 may include the photoconductor 11 and at least one of the charger 12, the development device 13, and the cleaner 15.

According to the above-described exemplary embodiments, each of the development device 13 depicted in FIG. 2 and the development device 131 depicted in FIG. 9 includes three conveyance members, which are the first conveyance screw 13B1, the second conveyance screw 13B2, and the third conveyance screw 13B3. Each of the development device 132 depicted in FIG. 10 and the development device 133 depicted in FIG. 11 includes two conveyance members, which are the first conveyance screw 13B1 and the second conveyance screw 13B2. Alternatively, each of the development devices 13, 131, 132, and 133 may include four or more conveyance members. In this case also, the discharge conveyance path P4 formed by the discharge conveyance screw 13K may be provided within the length X in which a circulation path formed by the four or more conveyance members is provided in a horizontal direction perpendicular to a long direction of the four or more conveyance members, providing effects equivalent to the effects provided by the development devices 13, 131, 132, and 133.

According to the above-described exemplary embodiments, the discharge conveyance path P4 formed by the discharge conveyance screw 13K is provided at the position within the length X in which the circulation path formed by the plurality of conveyance members is provided in the horizontal direction perpendicular to the long direction of the plurality of conveyance members, providing the development devices 13, 131, 132, and 133, the process cartridge 10, and the image forming apparatuses 1 and 1A using the pre-mixed development method and having a decreased size.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A development device for containing a developer containing toner and carrier and developing an electrostatic latent image formed on an image carrier, the development device comprising:

an inlet configured to supply fresh carrier to the development device;

a developer carrier provided opposite the image carrier and configured to carry the developer to be supplied to the electrostatic latent image formed on the image carrier;

a plurality of conveyance members configured to convey the developer contained in the development device in an axial direction of the development device to form a circulation path, the plurality of conveyance members including a first conveyance member provided opposite the developer carrier, and a second conveyance member provided at a position opposite the developer carrier and lower than the first conveyance member;

an outlet provided in a wall of a conveyance path formed by one of the plurality of conveyance members and configured to discharge the developer to an outside of the conveyance path when an amount of the developer conveyed by the one of the plurality of conveyance members exceeds a predetermined height; and a discharge conveyance member configured to form a discharge conveyance path to convey the developer discharged from the outlet in the axial direction of the development device and to discharge the developer to an outside of the development device, wherein the discharge conveyance path is disposed within a length in which the circulation path formed by the plurality of conveyance members is provided in a horizontal direction perpendicular to the axial direction of the development device, and wherein a center of rotation of the discharge conveyance member is disposed higher than a center of rotation of the first conveyance member in a height direction of the development device.

2. The development device according to claim 1, further comprising:

a developer regulating member configured to regulate an amount of the developer carried by the developer carrier, wherein the discharge conveyance path formed by the discharge conveyance member is provided at a position not higher than an upper end of the developer regulating member in a vertical direction.

3. The development device according to claim 1, wherein the first conveyance member provided opposite the developer carrier is configured to supply the developer to the developer carrier while conveying the developer in the axial direction of the development device to form a first conveyance path;

the second conveyance member provided at a position opposite the developer carrier and lower than the first conveyance member is configured to convey the developer separated from the developer carrier in the axial direction of the development device; and a third conveyance member is configured to convey the developer sent from the second conveyance member to an upstream portion of the first conveyance path formed by the first conveyance member and to convey the developer sent from a downstream portion of the first conveyance path to the upstream portion of the first conveyance path.

4. The development device according to claim 3, further comprising:

a ceiling provided near the outlet and the first conveyance member and above the first conveyance member, and configured to partially cover the first conveyance path formed by the first conveyance member.

5. The development device according to claim 1, wherein one end of the discharge conveyance member in the axial direction of the development device is rotatably supported.

6. The development device according to claim 5, wherein the discharge conveyance member contacts a wall of the discharge conveyance path while rotating.

7. The development device according to claim 1, wherein the discharge conveyance member comprises:

a shaft extending in the axial direction of the development device; and a screw wound around the shaft in a spiral shape, and wherein both ends of the screw in the axial direction of the development device are attached to the shaft.

8. The development device according to claim 1, further comprising:

an opening provided in the discharge conveyance path formed by the discharge conveyance member, wherein the developer falls under its own weight from the discharge conveyance path through the opening to a discharge path provided outside the development device.

9. The development device according to claim 1, wherein the inlet supplies fresh toner together with the fresh carrier to the development device.

10. An image forming apparatus, comprising:

an image carrier configured to carry an electrostatic latent image; and a development device configured to contain a developer containing toner and carrier and to develop the electrostatic latent image formed on the image carrier, the development device comprising:

an inlet configured to supply fresh carrier to the development device;

a developer carrier provided opposite the image carrier and configured to carry the developer to be supplied to the electrostatic latent image formed on the image carrier;

a plurality of conveyance members configured to convey the developer contained in the development device in an axial direction of the development device to form a circulation path, the plurality of conveyance members including a first conveyance member provided opposite the developer carrier, a second conveyance member provided at a position opposite the developer carrier and lower than the first conveyance member;

an outlet provided in a wall of a conveyance path formed by one of the plurality of conveyance members and configured to discharge the developer to an outside of the conveyance path when an amount of the developer conveyed by the one of the plurality of conveyance members exceeds a predetermined height; and a discharge conveyance member configured to form a discharge conveyance path to convey the developer discharged from the outlet in the axial direction of the development device and to discharge the developer to an outside of the development device, wherein the discharge conveyance path is disposed within a length in which the circulation path formed by the plurality of conveyance members is provided in a horizontal direction perpendicular to the axial direction of the development device, and wherein a center of rotation of the discharge conveyance member is disposed higher than a center of rotation of the first conveyance member in a height direction of the development device.

11. The image forming apparatus according to claim 10, wherein the development device further comprises a developer regulating member configured to regulate an amount of the developer carried by the developer carrier, and wherein the discharge conveyance path formed by the discharge conveyance member is provided at a position not higher than an upper end of the developer regulating member in a vertical direction.

12. The image forming apparatus according to claim 10, wherein the first conveyance member provided opposite the developer carrier is configured to supply the developer to the developer carrier while conveying the developer in the axial direction of the development device to form a first conveyance path;

the second conveyance member provided at a position opposite the developer carrier and lower than the first conveyance member is configured to convey the developer separated from the developer carrier in the axial direction of the development device; and a third conveyance member is configured to convey the developer sent from the second conveyance member to an upstream portion of the first conveyance path formed by the first conveyance member and to convey the developer sent from a downstream portion of the first conveyance path to the upstream portion of the first conveyance path.

13. The image forming apparatus according to claim 12, wherein the development device further comprises a ceiling provided near the outlet and the first conveyance member and above the first conveyance member, and configured to partially cover the first conveyance path formed by the first conveyance member.

14. The image forming apparatus according to claim 10, wherein one end of the discharge conveyance member in the axial direction of the development device is rotatably supported.

15. The image forming apparatus according to claim 14, wherein the discharge conveyance member contacts a wall of the discharge conveyance path while rotating.

16. The image forming apparatus according to claim 10, wherein the discharge conveyance member comprises:

a shaft extending in the axial direction of the development device; and a screw wound around the shaft in a spiral shape, and wherein both ends of the screw in the axial direction of the development device are attached to the shaft.

17. The image forming apparatus according to claim 10, wherein the development device further comprises:

an opening provided in the discharge conveyance path formed by the discharge conveyance member, and wherein the developer falls under its own weight from the discharge conveyance path through the opening to a discharge path provided outside the development device.

18. A process cartridge detachably attachable to an image forming apparatus, the process cartridge comprising:

an image carrier configured to carry an electrostatic latent image; and a development device configured to contain a developer containing toner and carrier and to develop the electrostatic latent image formed on the image carrier, the development device and the image carrier integrated into the process cartridge as a single unit, the development device comprising:

an inlet configured to supply fresh carrier to the development device;

a developer carrier provided opposite the image carrier and configured to carry the developer to be supplied to the electrostatic latent image formed on the image carrier;

a plurality of conveyance members configured to convey the developer contained in the development device in an axial direction of the development device to form a circulation path, the plurality of conveyance members including a first conveyance member provided opposite the developer carrier, a second conveyance member provided at a position opposite the developer carrier and lower than the first conveyance member;

an outlet provided in a wall of a conveyance path formed by one of the plurality of conveyance members and configured to discharge the developer to an outside of the conveyance path when an amount of the developer conveyed by the one of the plurality of conveyance members exceeds a predetermined height; and a discharge conveyance member configured to form a discharge conveyance path to convey the developer discharged from the outlet in the axial direction of the development device and to discharge the developer to an outside of the development device, wherein the discharge conveyance path being disposed within a length in which the circulation path formed by the plurality of conveyance members is provided in a horizontal direction perpendicular to the axial direction of the development device, and wherein a center of rotation of the discharge conveyance member is disposed higher than a center of rotation of the first conveyance member in a height direction of the development device.

* * * * *